US008162715B2

(12) United States Patent
Mayer

(10) Patent No.: US 8,162,715 B2
(45) Date of Patent: Apr. 24, 2012

(54) REMOTE-CONTROLLED TOY VEHICLE

(75) Inventor: Mark S. Mayer, West Hills, CA (US)

(73) Assignee: Mattel, Inc., El Segundo, CA (US)

( * ) Notice: Subject to any disclaimer, the term of this patent is extended or adjusted under 35 U.S.C. 154(b) by 248 days.

(21) Appl. No.: 12/424,215

(22) Filed: Apr. 15, 2009

(65) Prior Publication Data

US 2009/0264046 A1 Oct. 22, 2009

Related U.S. Application Data

(60) Provisional application No. 61/045,300, filed on Apr. 16, 2008.

(51) Int. Cl.
*A63H 17/00* (2006.01)

(52) U.S. Cl. ..... 446/440; 446/431; 446/457; 446/454; 446/456

(58) Field of Classification Search ..... 446/454, 446/456, 440, 437, 431, 457, 460, 462, 468–470
See application file for complete search history.

(56) References Cited

U.S. PATENT DOCUMENTS

| | | | | |
|---|---|---|---|---|
| 3,708,913 | A | 1/1973 | Terzian et al. | |
| 4,290,228 | A | 9/1981 | Goldfarb et al. | |
| 4,309,841 | A | 1/1982 | Asano | |
| 4,349,986 | A | 9/1982 | Tsukuda | |
| 4,363,186 | A | 12/1982 | Goldfarb et al. | |
| 4,457,101 | A | 7/1984 | Matsushiro | |
| 4,529,391 | A | 7/1985 | Hoshino et al. | |
| 4,556,397 | A | 12/1985 | Arad et al. | |
| 4,666,420 | A | 5/1987 | Nagano | |
| 4,680,021 | A * | 7/1987 | Maxim | 446/437 |
| 4,705,487 | A | 11/1987 | Ishimoto | |
| 4,846,758 | A | 7/1989 | Chou | |
| 4,892,503 | A | 1/1990 | Kumazawa | |
| 5,019,009 | A | 5/1991 | Chao-Chin et al. | |
| 5,334,076 | A | 8/1994 | Shinozuka | |
| 5,709,583 | A * | 1/1998 | Suto et al. | 446/440 |
| 5,727,986 | A | 3/1998 | Stubenfoll et al. | |

(Continued)

FOREIGN PATENT DOCUMENTS

GB 2328621 A 3/1999

OTHER PUBLICATIONS

International Search Report of PCT/US2009/040777; filed Apr. 16, 2009, dated Jun. 19, 2009 in a corresponding application, 3 pages.

*Primary Examiner* — Gene Kim
*Assistant Examiner* — Urszula M Cegielnik
(74) *Attorney, Agent, or Firm* — Panitch Schwarze Belisario & Nadel LLP

(57) ABSTRACT

A toy vehicle includes a chassis, a front road wheel supported for rotation from the chassis and a rear road wheel supported for rotation from the chassis. A reversible motor is supported from the chassis and is operatively coupled with one of the front and rear road wheels so as to rotate at least one of the front and rear road wheels to propel the toy vehicle in a forward direction. A wheelie mechanism is operatively connected to the motor and has a first end pivotally attached to the central axis of one of the front and rear road wheels.

20 Claims, 7 Drawing Sheets

U.S. PATENT DOCUMENTS 5,803,790 A * 9/1998 Tilbor et al. ..... 446/465
5,820,439 A * 10/1998 Hair, III ..... 446/440
5,836,804 A 11/1998 Tsai
5,868,600 A 2/1999 Watanabe
5,871,386 A 2/1999 Bart et al.
5,882,241 A 3/1999 Mullaney et al.
5,888,135 A 3/1999 Barton, Jr. et al.
5,924,507 A 7/1999 Prather
6,095,891 A 8/2000 Hoeting et al.
6,129,607 A * 10/2000 Hoeting et al. ..... 446/396
6,482,069 B1 * 11/2002 Tilbor et al. ..... 446/440
6,517,408 B1 * 2/2003 Rehkemper et al. ..... 446/440
6,540,583 B1 4/2003 Hoeting et al.
6,551,169 B2 4/2003 Jaffe
6,682,394 B2 * 1/2004 Tilbor et al. ..... 446/440
6,786,796 B2 9/2004 Suto
6,854,547 B2 2/2005 Moll et al.
7,234,990 B2 6/2007 Leonov et al.
7,288,017 B2 * 10/2007 Mukaida ..... 446/440
7,291,053 B2 * 11/2007 Mukaida ..... 446/456
7,686,671 B2 * 3/2010 Gotou et al. ..... 446/440
2007/0298678 A1 12/2007 Gotou et al.

* cited by examiner

REMOTE-CONTROLLED TOY VEHICLE

CROSS-REFERENCE TO RELATED APPLICATIONS

The present application claims the benefit of U.S. Provisional Patent Application No. 61/045,300, filed on Apr. 16, 2008 and entitled "Remote-Controlled Toy Vehicle," which is herein incorporated by reference in its entirety.

BACKGROUND OF THE INVENTION

The present invention relates generally to toy vehicles, and, more particularly, to remotely controlled, two-wheeled toy vehicles, such as motorcycles, capable of performing "wheelies" and/or driving/maneuvering in both a generally horizontal operating position and a generally vertical operating position.

Remote controlled, two-wheeled toys vehicles (i.e., motorcycles, motorbikes and scooters) are generally known. Consumers today, especially those that play with dynamic toys such as remote controlled motorcycles, desire realistic effects. "Popping a wheelie," for example, is a maneuver or trick in which a bicycle, motorcycle or car has one or more of its wheels, for example its front wheel or wheels, momentarily lifted off of the ground. Unfortunately, it can be difficult to create a remotely controlled motorcycle, or any other remotely controlled vehicle, that is capable of performing such a maneuver for a variety of reasons.

Therefore, it would be desirable to create a remote controlled toy vehicle that is capable of quickly and easily "popping a wheelie" and/or driving/maneuvering in both a generally horizontal operating position and a generally vertical operating position. Specifically, it would be desirable to create a wheelie mechanism for a toy vehicle that lifts the front wheel(s) off of the ground, at least momentarily, such that the toy vehicle can be driven in a generally vertical configuration.

BRIEF SUMMARY OF THE INVENTION

Briefly stated, the present invention is a toy vehicle that includes a chassis, a front road wheel supported for rotation from the chassis and a rear road wheel supported for rotation from the chassis in line with the front road wheel so as to define a central vertical longitudinal plane bisecting each of the front and rear road wheels. Each of the front and rear road wheels being supported from the chassis for rotation at least about a central axis of each respective wheel extending transversely to the central vertical longitudinal plane. A reversible motor is supported from the chassis and is operatively coupled with one of the front and rear road wheels so as to rotate at least one of the front and rear road wheels to propel the toy vehicle in a forward direction. A wheelie mechanism is operatively connected to the motor and has a first end pivotally attached to the central axis of one of the front and rear road wheels.

In another aspect, the present invention is a toy vehicle that includes a chassis, a front road wheel supported for rotation from the chassis and a rear road wheel supported for rotation from the chassis. Each of the front and rear road wheels being supported from the chassis for rotation about a central axis of each respective wheel. A motor is supported from the chassis and a wheelie mechanism is pivotally attached to the central axis of one of the front and rear road wheels. A propulsion system operatively connects the motor to one of the front and rear road wheels. The propulsion system includes a series of gears through which the motor effectuates rotation of one of the front and rear road wheels to propel the toy vehicle forward. A wheelie system operatively connects the motor to the wheelie mechanism. The wheelie system includes a series of gears through which the motor effectuates rotation of the wheelie mechanism. The motor selectively propels the toy vehicle forward in a generally horizontal operating position in which both the front and rear road wheels contact a supporting surface and in a generally vertical operating position in which the front road wheel is spaced apart from the supporting surface and the rear road wheel contacts the supporting surface.

In yet another aspect, the present invention is a method of driving a toy vehicle, having in-line front and rear road wheels and a wheelie mechanism, in a generally horizontal operating position in which the front and rear road wheels contact a supporting surface and in a generally vertical operating position in which the front road wheel is spaced-apart from the supporting surface. The steps include actuating a motor on the toy vehicle to rotate in a first rotational direction to rotate one of the front and rear road wheels to propel the toy vehicle in a forward direction and actuating the motor to rotate in a second rotational direction to rotate the one of the front and rear road wheels to propel the toy vehicle in a forward direction and to pivot a portion of the wheelie mechanism away from the toy vehicle to raise a remaining one of the front and rear road wheels off of the supporting surface.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there is shown in the drawings two embodiments which are presently preferred. It should be understood, however, that the invention is not limited to the precise arrangements and instrumentalities shown.

In the drawings.

DETAILED DESCRIPTION OF THE INVENTION

Figure 1:
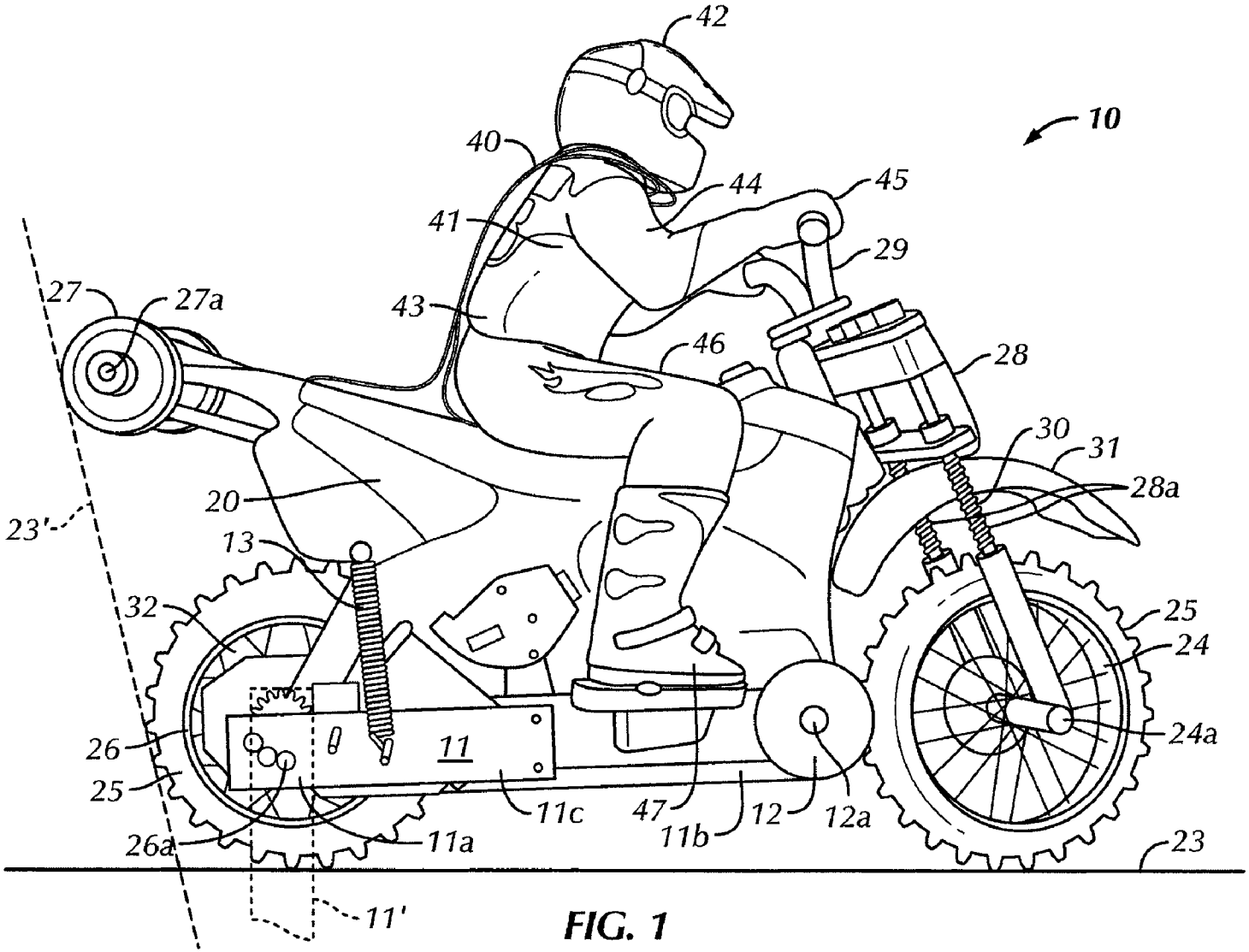
FIG. 1 is an right side elevation view of a toy vehicle in a generally horizontal operating position in accordance with a first preferred embodiment of the present invention, with the left side elevation view being a mirror image.

Certain terminology is used in the following description for convenience only and is not limiting. The words "right,"

"left," "upper," and "lower" designate directions in the drawings to which reference is made. The words "first" and "second" designate an order or operations in the drawings to which reference is made, but do not limit these steps to the exact order described. The words "inwardly" and "outwardly" refer to directions toward and away from, respectively, the geometric center of the toy vehicle and designated parts thereof. Additionally, the term "a," as used in the specification, means "at least one." The terminology includes the words above specifically mentioned, derivatives thereof, and words of similar import.

Referring to the drawings in detail, wherein like numerals indicate like elements throughout, there is shown in FIGS. 1-6 a first preferred embodiment of a toy vehicle, in particular, a toy motorcycle, generally designated 10, in accordance with the present invention. Although reference is made specifically to a two wheeled toy motorcycle 10, it is understood by those skilled in the art that the specific structure, systems and/or mechanisms described herein may be employed in virtually any type of toy vehicle, such as automobiles, trucks, bicycles, all-terrain vehicles ("ATV"), motor bikes, scooters, etc., and having any number of wheels.

Referring to FIG. 1, the toy vehicle 10 comprises a vehicle "chassis," indicated generally at 20, and a single rider figurine (or simply "rider") 40 attached thereto. The "chassis" 20 may be the frame of a true frame and body construction or a combined frame and body housing of monocoque construction such as a housing formed by mating together half shells. Although it is preferable that the vehicle 10 have an exterior made to look like a motorcycle, it is within the spirit and scope of certain aspects of the present invention that the monocoque vehicle chassis 20 be shaped to look like another type of two-wheeled vehicle, for example, a scooter or bicycle. Preferably, the chassis 20 is made up of left and right shells (not shown) attached to one another using conventional fasteners such as screws, bolts, rivets, and/or other conventional means of attaching such as staking, adhesives, fusion, etc. Although a mating two-shell monocoque arrangement is preferred, the chassis 20 may be formed of a conventional frame and body construction.

Front and rear road wheels 24, 26 are supported for rotation from the chassis 20, the rear road wheel 26 being in line with the front road wheel 24 so as to define a central vertical longitudinal plane of the chassis 20 parallel to the plane of FIG. 1 and bisecting each of the front and rear road wheels 24, 26. Preferably two stunt or prop wheels 27 are rotatably supported by a conventional stub axle or shaft 27*a* at a rear end of the chassis 20 and generally spaced above the rear road wheel 26 when the toy vehicle 10 is in a generally horizontal, normal operating position (FIG. 1) with front and rear road wheels 24, 26 located on a supporting surface 23. In the present embodiment, each prop wheel 27 is preferably located on a separate lateral side of the central vertical longitudinal plane of the chassis 20. However, it is understood by those skilled in the art that the toy vehicle 10 is not limited to the inclusion of two prop wheels 27, but may include only one prop wheel or more than two prop wheels. Further, the location of the prop wheel(s) 27 is/are not limited to that shown and described herein.

The rider 40 is shaped to look like an actual rider of a racing motorcycle. The rider 40 has a head 42, torso 41, mid-section 43, arms 44, hands 45, legs 46, and feet 47. The single rider 40 is seated atop the chassis 20 with its legs 46 extending generally downwardly along the opposing lateral sides of the chassis 20. In the preferred embodiment, the rider 40 is fixed to the vehicle chassis 20 at least four locations. The arms 44 extend generally frontwardly such that the hands 45 grasp handlebars 29. In the preferred embodiment, the hands 45 are fixed to the handlebar 29. Although the feet 47 may include a screw and socket assembly or a ball and socket joint for pivotable engagement with the chassis 20, in the preferred embodiment, the feet 47 of the rider 40 are simply fixed with or to the chassis 20. Additionally, the rider 40 may be fixed via threaded fasteners or other conventional forms of fastening to the top of the chassis 20.

Alternatively, the rider 40 may be articulated at various locations, as is described in U.S. Pat. No. 6,729,933, which is herein incorporated by reference. For example, the joints formed between the torso 41 and the arms 44 may be constructed such that the rider 40 may shift from side to side with relatively little if any resistance. Furthermore, a joint may be formed between the torso 41 and the mid-section 43 so that the torso 41 and mid-section 43 could move relative to each other. In addition, joints formed between the legs 45 and the mid-section 43 could be constructed such that the legs 46 and mid-section 43 may move relative to each other. The rider 40 may be articulated at the joints described above so that the rider 40 may shift from side to side without resistance in the direction that the toy vehicle 10 leans.

In FIG. 1, the toy vehicle 10 is shown in the generally horizontal, normal operating position, in which both the front and rear road wheels 24, 26 are in contact with the supporting surface 23, such as a floor or a table top. In this configuration, the toy vehicle 10 is capable of being driven or maneuvered by a wireless remote control transmitter 105 (FIG. 4), as is described in greater detail below. However, the toy vehicle 10 is also capable of being operated, driven and/or maneuvered by the wireless remote control transmitter 105 in a generally vertical operating position (depicted in phantom), such that the prop wheels 27, the rear road wheel 26 and a wheelie wheel 12 (described in further detail below) are preferably in contact with the supporting surface as shown in phantom at 23'. In the generally vertical operating position, the front road wheel(s) 24 is spaced-apart from and is not in contact with the supporting surface 23, 23' such that the toy vehicle 10 performs a "wheelie." However, the systems and structure described herein may be reversed/inverted such that the front road wheel 24 propels the toy vehicle 10 and the rear road wheel 26 is spaced-apart from the supporting surface 23 when the toy vehicle 10 "pops a wheelie."

Figure 4:
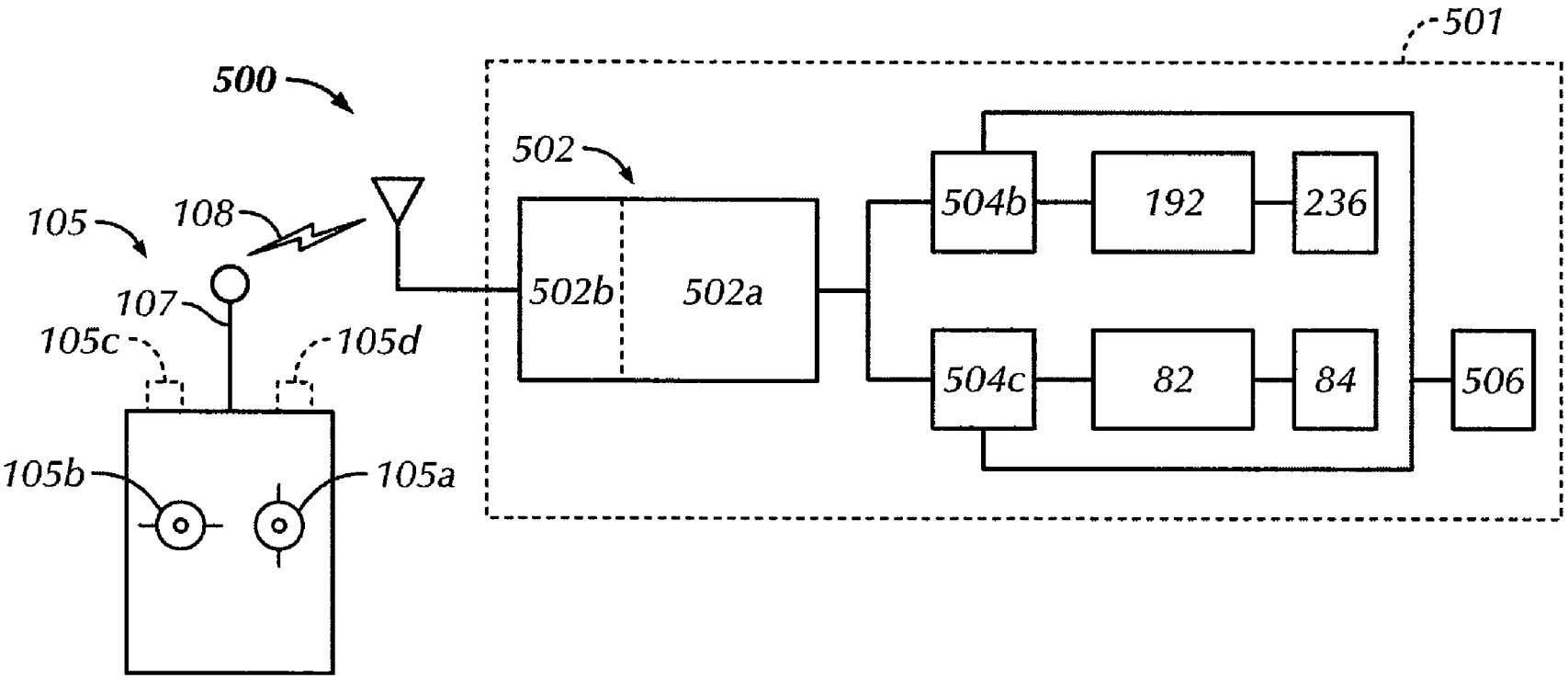
FIG. 4 is a schematic diagram of a wireless remote control transmitter and an on-board control unit of the toy vehicle shown in FIG. 1.

Referring specifically to FIG. 4, the toy vehicle 10 is configured to be operably controlled by a wireless remote control transmitter 105. Preferably, the toy vehicle 10 is controlled via radio (wireless) signals 108 from the wireless remote control transmitter 105. However, other types of controllers may be used including other types of wireless controllers (e.g., infrared, ultrasonic and/or voice-activated controllers) and even wired controllers and the like. Further, the toy vehicle 10 may be controlled by a wireless remote control transmitter having a pistol grip handle (not shown) which is grasped by a user.

The toy vehicle 10 is provided with a conventional circuit board 501 mounting control circuitry 500. The control circuitry 500 includes a controller 502 having a wireless signal receiver 502*b* and a microprocessor 502*a*, plus any necessary related elements such as memory. However, the elements of the circuitry do not have to be clustered together. For example, the wireless signal receiver 502*b* can be disposed within the chassis 20 or any other suitable location within or on the toy vehicle 10. The control circuitry 500 further includes a steering servo 192 and a motor 82, each respectively connected with an oscillating or steering lever 236 and a pinion 84. The motor 82 and servo 192 are controlled by the microprocessor 502*a* through motor control subcircuits 504*b*,

504*c* which, under control of the microprocessor 502*a*, selectively couple the motor 82 and servo 192 with an electric power supply 506 (such as one or more disposable or rechargeable batteries) in a suitable direction as both the motor 82 and servo 192 are reversible. Preferably, the power supply 506 can provide a current of approximately 400-500 milliamps when it is fully charged. It will be appreciated from later description that the steering "servo" 192 is not a conventional actuator with feedback, but is used to refer to an electromagnetically generated actuator having an armature which is limited in rotary movement to less than one full revolution of the armature and, in the present case, less than even one-half revolution.

Figure 2:
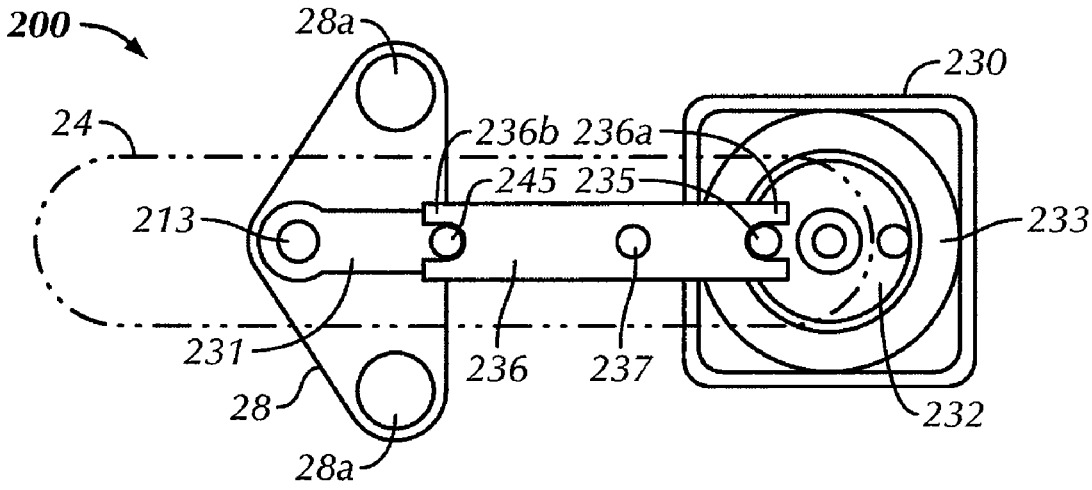
FIG. 2 is a top plan view of a steering mechanism of the toy vehicle of FIG. 1, in which a front wheel of the toy vehicle is in a straight or neutral position.
Figure 3:
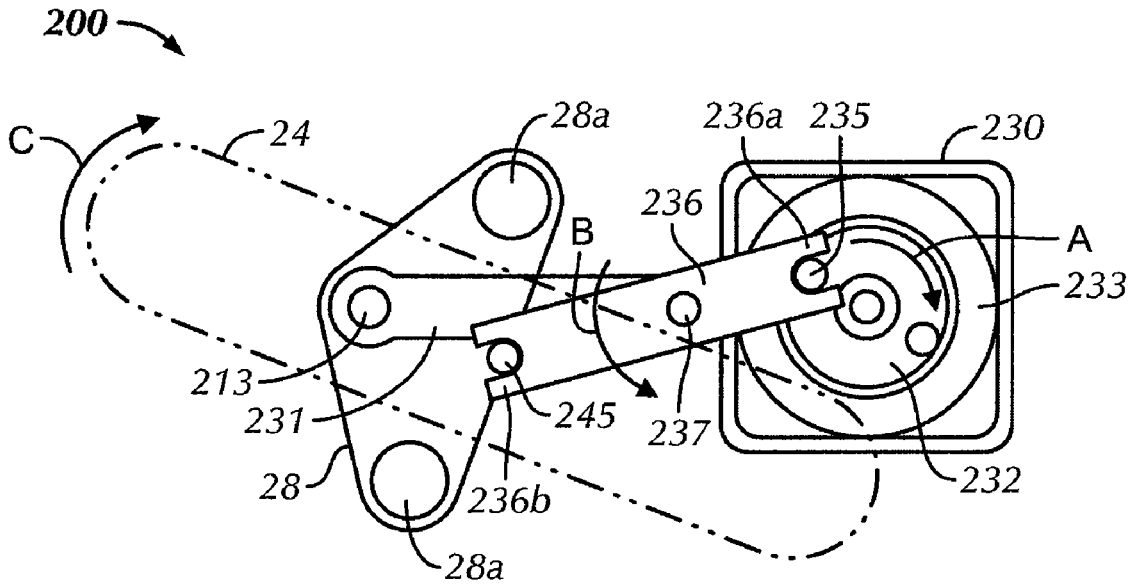
FIG. 3 is a top plan view of the steering mechanism shown in FIG. 2, with the front wheel in a direction-changing position.

In operation, the wireless remote control transmitter 105 sends control signals to the toy vehicle 10 that are received by the wireless signal receiver 502*b*. The wireless signal receiver 502*b* is in communication with and is operably connected with the steering servo 192 and motor 82 through the microprocessor 502*a* for controlling the toy vehicle's 10 speed and maneuverability. Operation of the steering servo 192 will be described later in connection with a steering mechanism 200 (FIGS. 2 and 3). Operation of the motor 82 serves to rotate the various gears (see FIG. 5, though not to scale), thus controlling the speed and, if applicable, the maneuverability of the toy vehicle 10. The motor 82, servo 192 and couplings are conventional devices readily known in the art and a detailed description of their structure and operation is not necessary for a complete understanding of the present invention. An exemplary motor can include a brushless electric motor providing, for example, a minimum of 1,360 revolutions per minute per volt.

The wireless remote control transmitter 105 may include a first manual actuator 105*a*, which preferably controls the forward motion of the toy vehicle 10 and operation of a wheelie mechanism 11 (as described in detail below), and at least a second manual actuator 105*b*, which preferably controls the steering of the toy vehicle 10. The wireless remote control transmitter 105 may instead also include a manual actuator 105*c* which permits selective operation of the wheelie stunt feature or wheelie system 400 of the present invention by the vehicle operator. The first manual actuator 105*a* could then be used for braking, for example, dynamic braking using the motor 82 or rear road wheel 26, if that feature is desired. The wireless remote control transmitter 105 may also include other manual actuator 105*d*, for example, or other buttons (not shown), which can be used to control other aspects of the toy vehicle 10, such as lighting and production of sound effects from a speaker (not shown) disposed within the toy vehicle 10, if either or both features are provided. The wireless remote control transmitter 105 preferably includes an antenna 107 extending upwardly from the top of the controller 105. One of ordinary skill in the art would recognize that other controllers with different shapes and functions could be used so long as the toy vehicle 10 can be properly controlled.

Figure 5:
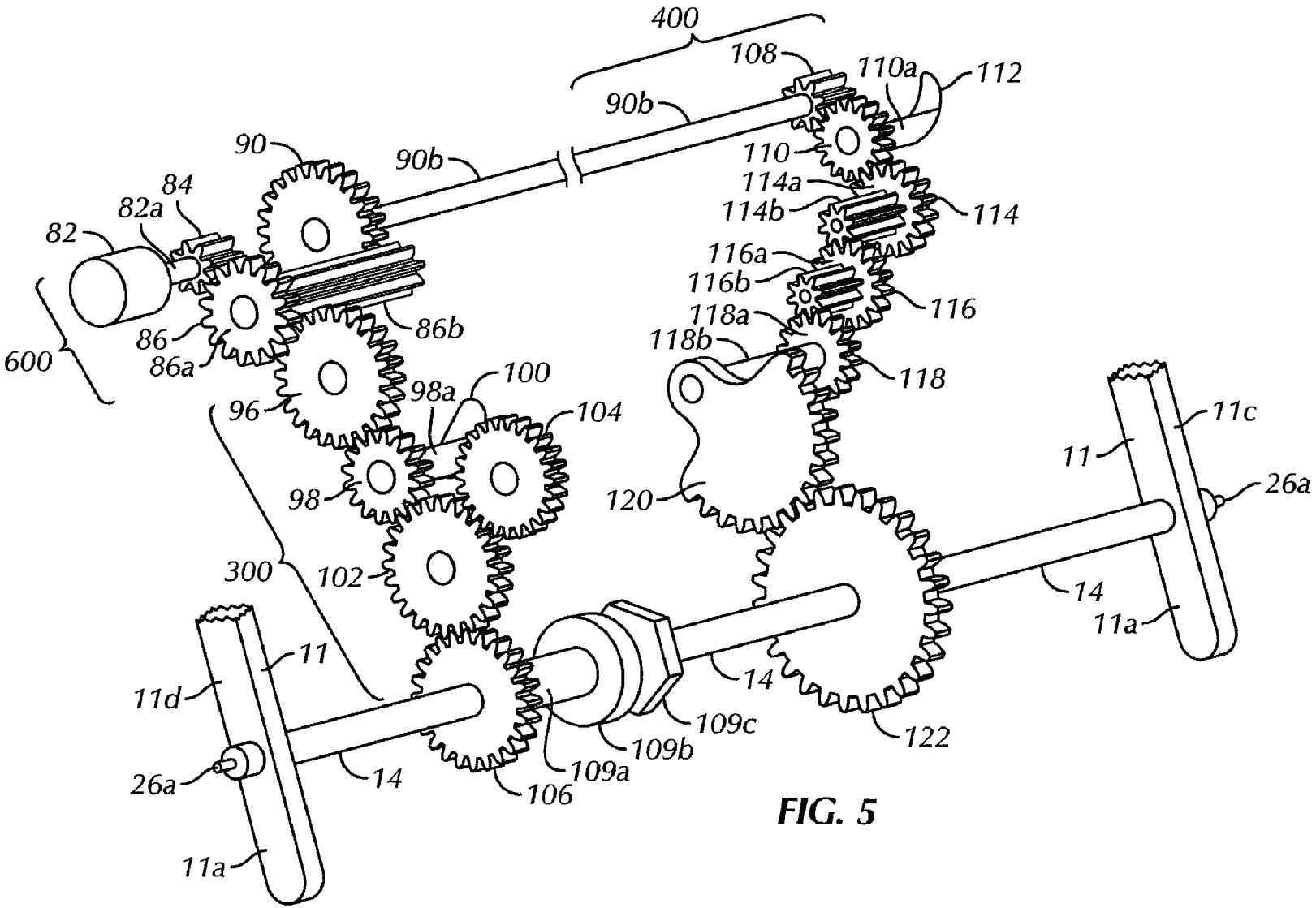
FIG. 5 is a magnified perspective view of a gear reduction system, a propulsion system and a wheelie system of the toy vehicle shown in FIG. 1.

As seen in FIGS. 1 and 5, to effectuate the change in configuration of the toy vehicle 10 from the generally horizontal operating position (FIG. 1) to the generally vertical operating position (depicted in phantom in FIG. 1), the toy vehicle 10 preferably includes the wheelie mechanism 11. As used herein, a wheelie mechanism 11 includes one or more levers or an assembly supported for operation generally proximate a bottom of the chassis 20 and above the supporting surface 23 and extendable by a connected actuation device or system (i.e., "wheelie system") downwardly against the supporting surface 23 sufficiently to at least momentarily lift one or more non-driven road wheels of a toy vehicle off the supporting surface 23 and shift the vehicle center of gravity closer to or over the driven road wheel(s). This relocation of the center of gravity may require some forward movement of the toy vehicle 10 during the extension of the wheelie mechanism 11 to complete movement of the center of gravity over or past the center of the driven wheel(s) 26.

Figure 6:
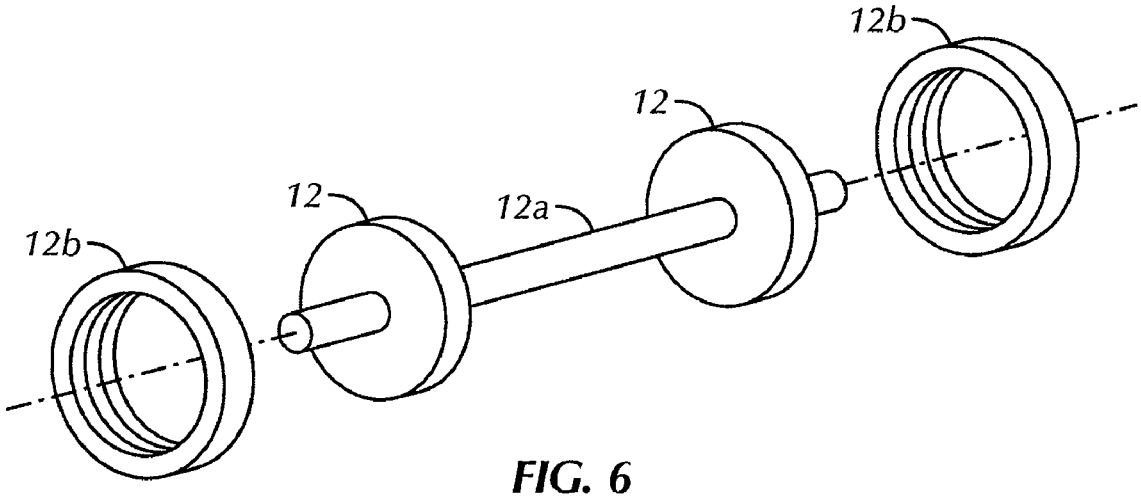
FIG. 6 is a magnified partially exploded view of a wheelie wheel assembly of the toy vehicle shown in FIG. 1.

The present wheelie mechanism 11 is preferably comprised of two spaced-apart wheelie bars 11*c*, 11*d* that are preferably located generally proximal to the bottom of the chassis 20 when the toy vehicle 10 is in the generally horizontal operating position (FIG. 1). Specifically, a first or right wheelie bar 11*c* is generally located on a right side of the chassis 20 and a second or left wheelie bar 11*d* is generally located on a left side of the chassis 20. The first end 11*a* of each wheelie bar 11*c*, 11*d* is pivotably mounted preferably to a rear axle 26*a* of the toy vehicle 10 also supporting the rear road wheel 26. The rear axle 26*a* defines a central axis of the rear road wheel 26, which extends transversely to the central vertical longitudinal plane. The second opposite end 11*b* of each wheelie bar 11*c*, 11*d* includes at least one wheelie wheel 12 rotatably mounted thereto. As seen in FIG. 6, the two wheelie wheels 12 are preferably positioned at a spaced-apart distance on either side of each wheelie bar 11*c*, 11*d* supported by a conventional stub axle or shaft 12*a* through the bar 11*c*, 11*d*. The wheelie wheels 12 are preferably sized and shaped such that a tire 12*b* may be wrapped around the circumferential outer edge of the wheel 12, if desired.

It is understood by those skilled in the art that the toy vehicle 10 is not limited to the specific size, shape, location of the wheelie bars 11*c*, 11*d*, as described above. Further, the toy vehicle 10 may a wheelie mechanism 11 formed of only one central wheelie bar (not shown) or more than two wheelie bars (not shown), without departing from the spirit and scope of the present invention. As seen in FIG. 5, a bias member 13, preferably in the form of a coil spring, may connect a portion of one or each of the wheel bars 11*c*, 11*d* to the chassis 20 of the toy vehicle 10. Operation of the wheelie mechanism 11, bias member 13 and wheelie wheels 12 is described in further detail below.

Referring to FIGS. 1-3, a steering fork 28 is pivotally attached proximate the front of the chassis 20. The steering fork 28 preferably includes legs 28*a* which extend generally downwardly from proximate the front of the chassis 20. A fork 28 with solid legs is preferred, but the legs of the fork 28 may be telescopic and have a spring on each side of the fork 28 to allow the sliding movement of the bottom of the fork 28 with respect to the top of the fork 28 so as to act as a front suspension for the toy vehicle 10. In the present embodiment, springs 30 surround each end of the legs 28*a* to provide a front suspension for the toy vehicle 10. A front axle 24*a* rotatably supporting the front road wheel 24 is engaged between the legs 28*a* of the fork 28 proximate the bottom of the legs 28*a*. The front axle 24*a* defines a central axis of the front road wheel 24, which extends transversely to the central vertical longitudinal plane. It is understood by those skilled in the art that a front fender 31 may be included on the toy vehicle 10, but is not necessary.

Preferably, the front and rear road wheels 24, 26 are shaped and sized such that a tire 25 may be wrapped around the circumferential outer edge of each. The tires 25 are preferably made of a soft polymer such as a soft polyvinyl chloride (PVC) or an elastomer selected from the family of styrenic thermoplastic elastomers polymers sold under the trademark KRAYTON POLYMERS so as to increase traction and improve control of the toy vehicle 10. It is also preferred that the tires 25 are essentially identical in dimension and construction and oversized to provide additional stability for the toy vehicle 10. The tires 25 may be solid polymer or a polymer shell filled with a foam or hollow and sealed, preferably with a valve for inflating and adjusting the pressure level of the tires 25. One of ordinary skill in the art would recognize that other sizes and materials could be substituted, such as, but not limited to, silicone, polyurethane foam, latex, and rubber. Moreover, the tires could be open to atmosphere or sealed. In the preferred embodiment, each of the tires 25 has knobs for gripping and traction, particularly off pavement terrain including but not limited to sand, dirt and grass.

Referring now to FIGS. 1-3, the toy vehicle 10 preferably includes an electromagnetic steering mechanism 200 that allows the user to quickly and accurately change the direction of which the toy vehicle 10 is driven. Specifically, steering mechanism 200 includes an arm portion 231 which is extended in a longitudinal direction between a front side surface of a case 230 accommodating a ring-shaped permanent magnet 233 surrounding an electromagnetic coil 232, and a caster axis 213 about which the steering fork 28 and front road wheel 24 are pivoted to steer toy vehicle 10. Case 230 accommodates the steering servo 192 (FIG. 4) including an armature (not shown). The electromagnetic coil 232 is arranged in a center portion of the ring-shaped magnet 233 to pivot on an axis 234 within the case 230. Further, an engaging piece 235 is formed in a peripheral edge portion of the coil 232 to pivot about the axis 234.

The rotation of the electromagnetic coil 232 is transmitted to the steering fork 28 by the oscillating or steering lever 236. The oscillating lever 236 is mounted to an axis 237 protruding from the arm portion 231 in a freely pivoting manner. Longitudinal ends 236*a* and 236*b* of lever 236 are pivotally coupled with engaging piece 235 of the electromagnetic coil 232 and a projection portion 245 provided in the steering fork 28. Controller 502*a* supplies a control current via motor control circuit 504*b* in response to steering control signals received from transmitter 105, causing the electromagnetic coil 232 to rotate within the ring-shaped magnet 233, and pivot the oscillating lever 236 so as to change the direction of the steering fork 28.

To change the direction of the toy vehicle 10, a signal for changing the direction from the transmitter 105 is received via the antenna (not shown), the control signal for changing the direction is applied to the electromagnetic coil 232 from a receiving circuit (not shown). For example, rotating the electromagnetic coil 232 in a first direction A (as shown in FIG. 3) within the ring-shaped magnet 233 causes the leading end 236*b* of the oscillating lever 236 provided in the arm portion 231 to pivot in a direction B. The steering fork 28 and front road wheel 24 are rotated in a direction C about the caster axis 213, whereby the direction of the front road wheel 24 mounted to the steering fork 28 is changed. It is understood by those skilled in the art that the toy vehicle 10 is not limited to the steering mechanism 200 as described above, but may employ virtually any system or mechanism to allow the user or operator to change the direction of the toy vehicle 10.

Referring to FIGS. 1, a weighted flywheel 32 is preferably housed within the rear wheel 26. The flywheel 32 enhances the stability and performance of the toy vehicle 10, especially in operation over rough or rugged terrain. As is understood by those skilled in the art, the flywheel 32 can spin substantially faster than the rear wheel 26 during operation of the toy vehicle 10 to provide a stabilizing gyroscopic effect. The rear wheel 26 and flywheel 32 are rotatively attached to the rear axle 26*a* of the toy vehicle 10. The flywheel 32 may include a flywheel with a clutch bell (not shown), a clutch assembly (not shown) and a gear assembly (not shown), as is described in U.S. Pat. No. 6,095,891, which is herein incorporated by reference. Although the rear wheel 26 of the present invention preferably includes a flywheel 32, it is understood by those skilled in the art that the toy vehicle is not limited to the inclusion of a flywheel. In fact, the toy vehicle 10 may include virtually any other mechanism that helps stabilize the toy vehicle 10.

Referring now to FIGS. 1 and 5, the toy vehicle 10 of the present invention preferably includes a single, reversible motor 82. The motor 82 may be any suitable light weight motor, but typically is a battery powered DC motor. The motor 82 allows the user to remotely effect operation of a propulsion or drive system 300 and the wheelie system 400 located generally within and/or proximate the chassis 20. Specifically, operation of the motor 82 in a "first" rotational direction drives the toy vehicle 10 forward (i.e. operates the propulsion system 300), while operation of the motor 82 in a "second" rotational direction, opposite the first, drives the toy vehicle 10 forward but also operates the wheelie system 400 such that the toy vehicle 10 "pops a wheelie" or is driven at least momentarily in the generally vertical operating position.

More particularly, when the motor 82 rotates a drive shaft 82*a* in the "second" direction (i.e., clockwise in FIG. 5 when viewing the motor 82 from the second or left wheelie bar 11*d*), the propulsion system 300 causes the rear wheel 26 to rotate in a counterclockwise direction, which in turn causes the toy vehicle 10 to move in a forward direction. This rotation of the drive shaft 82*a* in the second direction also causes the wheelie system 400 to rotate and/or pivot the wheelie mechanism 11 away from the chassis 20, such that the toy vehicle 10 "pops a wheelie" or moves to the generally vertical operating position. However, when the motor 82 rotates the drive shaft 82*a* in the "first" rotational direction (i.e. counterclockwise in FIG. 5 when viewing the motor 82 from the second or left wheelie bar 11*d*), opposite the second direction, the propulsion systems 300 is configured to cause the rear wheel 26 to still rotate in a counterclockwise direction, which drives the toy vehicle 10 forward. However, in this first rotational direction of the drive shaft 82*a*, the wheelie system 400 is not "engaged," such that the toy vehicle 10 drives in the generally horizontal operating position (FIG. 1).

Referring specifically to FIG. 5, the toy vehicle 10 preferably includes a gear reduction system 600 to reduce the speed and increase the torque at which the motor 82 rotates the rear road wheel 26 and/or wheelie mechanism 11. Specifically, the drive shaft 82*a* is rotatively engaged with the pinion 84. The pinion 84 rotatively engages a first reduction gear 86. The first reduction gear 86 includes a larger spur 86*a* and a smaller spur 86*b* fixedly attached thereto. The smaller spur 86*b* extends generally from a midsection of one side of the larger spur 86*a*. The smaller spur 86*b* is rotatively engaged with both a first propulsion gear 96 and first wheelie gear 90. The first propulsion gear 96 is generally the beginning of the propulsion system 300 and the first wheelie gear 90 is generally the beginning of the wheelie system 400. It is understood by those skilled in the art that the toy vehicle 10 is not limited to the specific arrangement of the gear reduction system 600, as described above. For example, the motor 82 may be positioned in a variety of orientations and/or locations within the chassis 20 of the toy vehicle 10. Further, the gear reduction system 600 may include more or fewer gears, depending, in part, on the speed of rotation of the motor 82.

The propulsion system 300 is generally in the form of a gear train that starts with rotation of the first propulsion gear 96. The first propulsion gear 96 is preferably in the form of a conventional spur gear. However, it is understood that the first propulsion gear 96 may be replaced by two or more gears to improve the positioning/orientation of the propulsion system 300 within the chassis 20, for example. In the present embodiment, as the first propulsion gear 96 is driven by rotation of the smaller spur 86*b* of the first reduction gear 86, the first propulsion gear 96 rotatively engages a propulsion toggle gear 98. A smaller shaft 98*a*, located on a side face of the propulsion toggle gear 98, preferably extends within a generally elongated slot 100 positioned within the chassis 20 of the toy vehicle 10. The smaller shaft 98*a* of the propulsion toggle gear 98 may include a plurality of ridges or teeth (not shown) that engage a plurality of complementary ridges or teeth (not shown) on a sidewall of/within the slot 100. However, the smaller shaft 98*a* of the propulsion toggle gear 98 may include virtually any type of engaging mechanism to assure that the smaller shaft 98*a* properly moves within the slot 100. Alternatively, the smaller shaft 98*a* may be formed of only a smooth surface to slide/ride along a smooth surface of the slot 100.

In operation, the propulsion toggle gear 98 is rotated by the rotation of the first propulsion gear 96 and moved vertically upwardly and/or downwardly by movement of the smaller shaft 98*a* within the range of the slot 100 by rotation of the first propulsion gear 96. For example, referring to FIG. 5, as the first propulsion gear 96 is rotated in a clockwise direction, the propulsion toggle gear 98 is rotated in a counterclockwise direction and moves to the lowest point within the slot 100. In this lowest position of the slot 100, propulsion toggle gear 98 rotatably engages a stationary or idler spur gear 102. This rotation of the propulsion toggle gear 98 in a counterclockwise direction meshes with the stationary spur gear 102, which causes the meshed stationary spur gear 102 to rotate in a clockwise direction. This clockwise rotation of the stationary spur gear 102 a housing gear 106 in a counterclockwise direction.

The housing gear 106 surrounds and is capable of being rotated independently of and/or freely with respect to the rear axle 26*a* and an extension 14 (described in detail below) of the wheelie mechanism 11. A central hub or other central portion (not shown) of the rear wheel 26 is attached and/or fixed to a portion of the housing gear 106. For example, a central hub of the rear wheel 26 may surround and directly engage an outer circumference of the housing gear 106. Alternatively, one or more of a series of connectors 109*a*, 109*b*, 109*c* may extend from a side of the housing gear 106 and be fixedly connected thereto, such that a central hub of the rear wheel 26 surrounds a portion of one or more of the connectors 109*a*, 109*b*, 109*c*. Thus, rotation of the housing gear 106 causes the rear wheel 26 to rotate in the same direction to propel the toy vehicle 10 forward.

However, referring again to FIG. 5, when the rotation of the motor 82 is reversed and the first propulsion gear 96 is rotated in a counterclockwise direction, the propulsion toggle gear 98 is rotated in a clockwise direction and moved upwardly to generally the uppermost extent of the slot 100. In this position, propulsion toggle gear 98 disengages from the stationary gear 102 and rotatably engages a reversing gear 104. In this configuration, the reversing gear 104 is rotated in a counterclockwise direction. The reversing gear 104, which constantly rotatively engages the stationary gear 102, then drives the stationary 102 in a clockwise direction. This clockwise rotation of the stationary gear 102 engages and rotates the housing gear 106 in a counterclockwise direction. As was described above, rotation of the housing gear 106 in a counterclockwise direction rotates the rear wheel 26 in a counterclockwise direction to propel the toy vehicle 10 forward. Thus, the propulsion system 300 can drive the toy vehicle 10 in a forward direction irrespective of the rotational output of the motor 82.

The wheelie system 400 is generally in the form of a reduction gear train that starts with rotation of the first wheelie gear 90. The wheelie system 400 only operates when the motor 82 is driven in the "second" rotational direction (i.e. clockwise in this particular embodiment). As seen in FIG. 5, the first wheelie gear 90 may include a shaft 90*b* that extends from a central midsection of a side of the first wheelie gear 90. In the present embodiment, a second end of the shaft 90*b* is attached to a second wheelie gear 108, which is spaced from the first wheelie gear 90, for example on an opposite side of the rear wheel (not shown in FIG. 5). This enables the gears of the propulsion system 300 and the wheelie system 400 to be run along opposite sides of the rear end of the chassis 20 forming a rear fork to receive the rear road wheel 26. However, it is understood by those skilled in the art that the first wheelie gear 90, shaft 90*b* and second wheelie gear 108 may be modified, combined and/or reduced to just the first wheelie gear 90. Those skilled in the art understand that FIG. 5 shows the first wheelie gear 90, shaft 90*b* and second wheelie gear 108 for clarity, since a compact gear system can be difficult to visually depict. However, the first wheelie gear 90, shaft 90*b* and second wheelie gear 108 can be reduced to just one gear to effectuate the same result if the gears of the propulsion and wheelie systems 300, 400 are run side-by-side along the same side of the rear road wheel 26.

In the present embodiment, as the second wheelie gear 108 is driven by rotation of the shaft 90*b* of the first wheelie gear 90, the second wheelie gear 108 rotatively engages a wheelie toggle gear 110. A shaft 110*a*, located on a side face of the wheelie toggle gear 110, preferably extends within an elongated slot 112 positioned within the chassis 20 of the toy vehicle 10. The shaft 110*a* is preferably smooth to slide/ride along a smooth surface of the slot 112. However, the shaft 110*a* of the wheelie toggle gear 110 may include virtually any type of engaging mechanism to assure that the shaft 110*a* properly moves within the slot 112.

In operation, the wheelie toggle gear 110 may be rotated by the rotation of the second wheelie gear 108 (or just the first wheelie gear 90 depending on the particular embodiment) and moved vertically upwardly and/or downwardly by movement of the shaft 110*a* within the range of the slot 112 by rotation of the second wheelie gear 108 (or just the first wheelie gear 90 depending on the particular embodiment). For example, referring to FIG. 5, as the motor 82 rotates the first reduction gear 86 in the "first" direction (i.e. clockwise in this particular embodiment), the first wheelie gear 90 is rotated in a clockwise direction (when viewed in FIG. 5 from the perspective of the second wheelie bar 11*d*). This clockwise rotation of the first wheelie gear 90 rotates the shaft 90*b* and second wheelie gear 108 in a clockwise direction. As the second wheelie gear 108 (or just the first wheelie gear 90 depending on the particular embodiment) is rotated in a clockwise direction, the wheelie toggle gear 110 is rotated in a counterclockwise direction and is forced to generally the lowest point within the slot 112. In this lowest position of the slot 100, the wheelie toggle gear 110 rotatably engages a first wheelie reduction gear 114 and causes it to rotate in a clockwise direction and eventually effectuate movement/rotation of the wheelie mechanism 11 (as described in detail below).

However, referring again to FIG. 5, when the operation of the motor 82 is reversed and the second wheelie gear 108 (or just the first wheelie gear 90) is rotated in the "second" direction (i.e. counterclockwise in this particular embodiment), the wheelie toggle gear 110 is rotated in a counterclockwise direction and moves upwardly in the slot 112 to generally the uppermost extent of the slot 112. In this position, the wheelie toggle gear 110 is lifted away from engagement with the first wheelie reduction gear 114 and movement/rotation of the wheelie mechanism cannot be effectuated. Thus, in a sense, in this configuration the gear train of the wheelie system 400 is cut or broken, such that the wheelie mechanism 11 is not forced away from the bottom of the chassis 20 of the toy vehicle 10, but instead generally remains in place proximate the bottom of the chassis 20. However, the toy vehicle 10 can still be driven/maneuvered in the generally vertical operating position even if the wheelie mechanism 11 is located proximate to and generally parallel with the bottom of the chassis 20.

As seen in FIG. 5, the wheelie system 400 includes the first wheelie reduction gear 114, a second wheelie reduction gear 116, and a third wheelie reduction gear 118. Each wheelie reduction gear 114, 116, 118 includes a larger spur and a smaller spur generally extending from a midsection of a side of the respective larger spur. This combination of larger and smaller spurs of the wheelie reduction gears 114, 116, 118 allows the wheelie system 400 to reduce the speed and increase the torque at which the motor 82 pivots and/or rotates the wheelie mechanism 11. Rotation of the smaller spur 118*b* of the third wheelie reduction gear 118 rotates, in turn and to a limited degree, a sector gear 120. As is understood by those skilled in the art, the sector gear 120 may be in the form of an eccentric shape (for example the shape shown in FIG. 5) having teeth (not shown) only along part of the outer circumference of the sector gear 120. Alternatively, the sector gear 120 may be circular and include a gap or gaps in its gear teeth (not shown). The eccentric shape or gaps/depressions allows for intermittent rotative engagement or meshing of the sector gear 120 with a base gear 122. The base gear 122 operatively engages at least one gear, preferably the sector gear 120, of the series of gears of the wheelie system 400. The base gear 122 surrounds and is fixedly connected to both the rear axle 26*a* and the extension 14 of the wheelie mechanism 11.

When driven by the third wheelie reduction gear 118, the sector gear 120 rotates the base gear 122 and extension 14. Ends 11*a* of the wheelie bars 11*c*, 11*d* are fixed to the extension 14 and are pivoted to an extended position (partially indicated in phantom at 11' in FIG. 1). The predetermined number of teeth and/or shape of the sector gear 120 allows the wheelie system 400 to be momentarily "disengage," after a partial revolution of the sector gear 120, such that the wheelie mechanism 11 can be pivoted back to the original position (shown in solid lines in FIG. 1) proximate to and generally parallel with the bottom of the chassis 20 by the retraction force of the bias member 13, for example. When the teeth of the sector gear 120 no longer engage the base gear 122, there is nothing forcing the wheelie mechanism 11 to the extended (i.e., "wheelie") position. Thus, the inherent tension in the extended bias member 13 pulls the wheelie mechanism 11 back toward the chassis 20. When the wheelie mechanism 11 is returned to the original position proximate the bottom of the chassis 20 (shown in solid lines in FIG. 1), the toy vehicle 10 can either continue to be driven in the generally vertical operating position, or, once the motor 82 has been stopped by direction of the user, the forward momentum of the toy vehicle 10 may cause the toy vehicle 10 to return to the generally horizontal operating position (FIG. 1). Alternatively, the toy vehicle 10 may have a center of gravity that is located at a predetermined point to encourage the toy vehicle 10 to return to the generally horizontal operating position once the wheelie mechanism 11 is returned to the original position proximate the bottom of the chassis 20.

In operation, as the second wheelie gear 108 (or just the first wheelie gear 90) is rotated in the "first" or clockwise direction (in this particular embodiment), the wheelie toggle gear 110 is moved downward within the slot 112 and rotated counterclockwise. This counterclockwise rotation of the wheelie toggle gear 110 causes it to engage and rotate the larger spur 114*a* of the first wheelie reduction gear 114 in a clockwise direction. This clockwise rotation of the larger spur 114*a* rotates the smaller spur 114*b* in a clockwise direction. The clockwise rotation of the smaller spur 114*b* rotates the larger spur 116*a* of the second wheelie reduction gear 116 in a counterclockwise direction. This rotation of the larger spur 116*a* also rotates the smaller spur 116*b* of the second wheelie reduction gear in the counterclockwise direction. This counterclockwise rotation of the smaller spur 116*b* rotates the larger spur 118*a* of the third wheelie reduction gear in a clockwise direction. Thus, the smaller spur 118*b* of the third wheelie reduction gear 118 is rotated in a clockwise direction and, in turn, rotates the sector gear 120 in a clockwise direction.

When the first tooth (not shown) of the sector gear 120 engages the base gear 122, the base gear 122 begins to rotate in a counterclockwise direction. The base gear 122 continues to rotate as long as the teeth of the sector gear 120 engage the base gear 122. The extension 14, which is fixedly mounted to and extends from the wheelie mechanism 11 and surrounds at least a portion of the rear axle 26*a*, is fixedly connected to the base gear 122. Thus, the counterclockwise rotation of the base gear 122 rotates the extension 14, which is fixedly mounted to and extends from the wheelie mechanism 11 and surrounds at least a portion of the rear axle 26*a*. As the extension 14 is rotated in a counterclockwise direction by rotation of the base gear 122, the wheelie mechanism 11 is also rotated in a counterclockwise direction such that the wheelie wheels 12 are moved from beneath the chassis 20 to the supporting surface 23 (i.e. the extended position). As the teeth of the sector gear 120 continue to rotate and engage the base gear 122, the wheelie mechanism 11 extends/pivots away from the chassis 20 and lifts/pivots the toy vehicle 10 to the generally vertical operating position (i.e., to "pop a wheelie"). In this position, the rear wheel 26 and the prop wheel(s) 27 support the chassis 20 of the toy vehicle 10 as the toy vehicle 10 is driven, but the front road wheel 24 is spaced-apart from and not contacting the support surface 23.

Those skilled in the art understand that the extension 14 surrounds and is fixed with respect to the rear axle 26*a*. As shown in FIG. 5, the extension 14 preferably extends through an open midportion of the base gear 122, the housing gear 106, and the series of connectors 109*a*, 109*b*, 109*c* that may extend from a side of the housing gear 106. However, the extension 14 is freely rotatable with respect to the housing gear 106 and series of connectors 109*a*, 109*b*, 109*c*, but is fixedly and rotatable with the base gear 122.

As long as the motor 82 is rotating the drive shaft 82*a* in the "second" rotational direction (i.e. counterclockwise in this particular embodiment), the wheelie system 400 remains "engaged." However, even when the wheelie system 400 remains engaged, the wheelie mechanism 11 may be rotated back towards the original position (i.e. juxtaposed with the bottom of the chassis 20) if the teeth of the sector gear 120 rotate past or do not engage the base gear 122. For example, when the base gear 122 does not engage the sector gear 120 because the last tooth (not shown) of the sector gear 120 has passed or no longer engages the base gear 122, the bias member 13 attached to a portion of the exterior of the chassis 20, when provided, pulls the wheelie mechanism 11 back towards the bottom of the chassis 20. To return the toy vehicle 10 from the generally vertical "wheelie" position to the generally horizontal, normal operating position (FIG. 1), the user preferably momentarily allows the toy vehicle 10 to slow down by reducing or stopping the speed at which the motor 82 rotates or by braking the toy vehicle 10 (if braking is a provided feature). As the rear wheel 26 is slowed when the toy vehicle 10 is in the generally vertical "wheelie" position, the momentum of the toy vehicle 10 returns the toy vehicle 10 to the generally horizontal operating position. It is understood by those skilled in the art, that the user or operator may periodically extend the wheelie mechanism 11 from the bottom of the chassis 20 and/or return the wheelie mechanism 11 to the bottom of the chassis 20 even if the toy vehicle 10 continues to be driven in the generally vertical or "wheelie" position.

It will further be appreciated that the wheelie mechanism 11 need not pivot a full ninety degrees to elevate the toy vehicle 10 into the vertical "wheelie" position. The toy vehicle 10 can be weighted in such a way that when the front of the toy vehicle 10 is raised to a sufficient angle, the center of gravity moves from in front of the rear wheel 26 to behind the point of contact of the rear wheel 26 with support surface 23, at which point the toy vehicle 10 will continue to rotate onto the prop wheels 27. Alternatively, the toy vehicle 10 can be designed so that some forward momentum is required before the wheelie mechanism 11 is actuated to throw the front road wheel 24 of the toy vehicle 10 off of the support surface 23 and an the rear of the toy vehicle 10 onto the prop wheels 27. Preferably, for the toy vehicle 10, the wheelie mechanism 11 is pivoted about sixty degrees from the position juxtaposed to the bottom of the chassis 20, but greater or lesser pivot angles can be provided.

It will further be appreciated that a limit switch (not shown) or the like can be provided operably connected with the sector gear 120 to signal to the controller 502*a* when the sector gear 120 has rotated one full revolution. At that point, the controller 502*a* can itself reverse the direction of rotation of the motor 82 to disengage the wheelie system 400.

Figure 7:
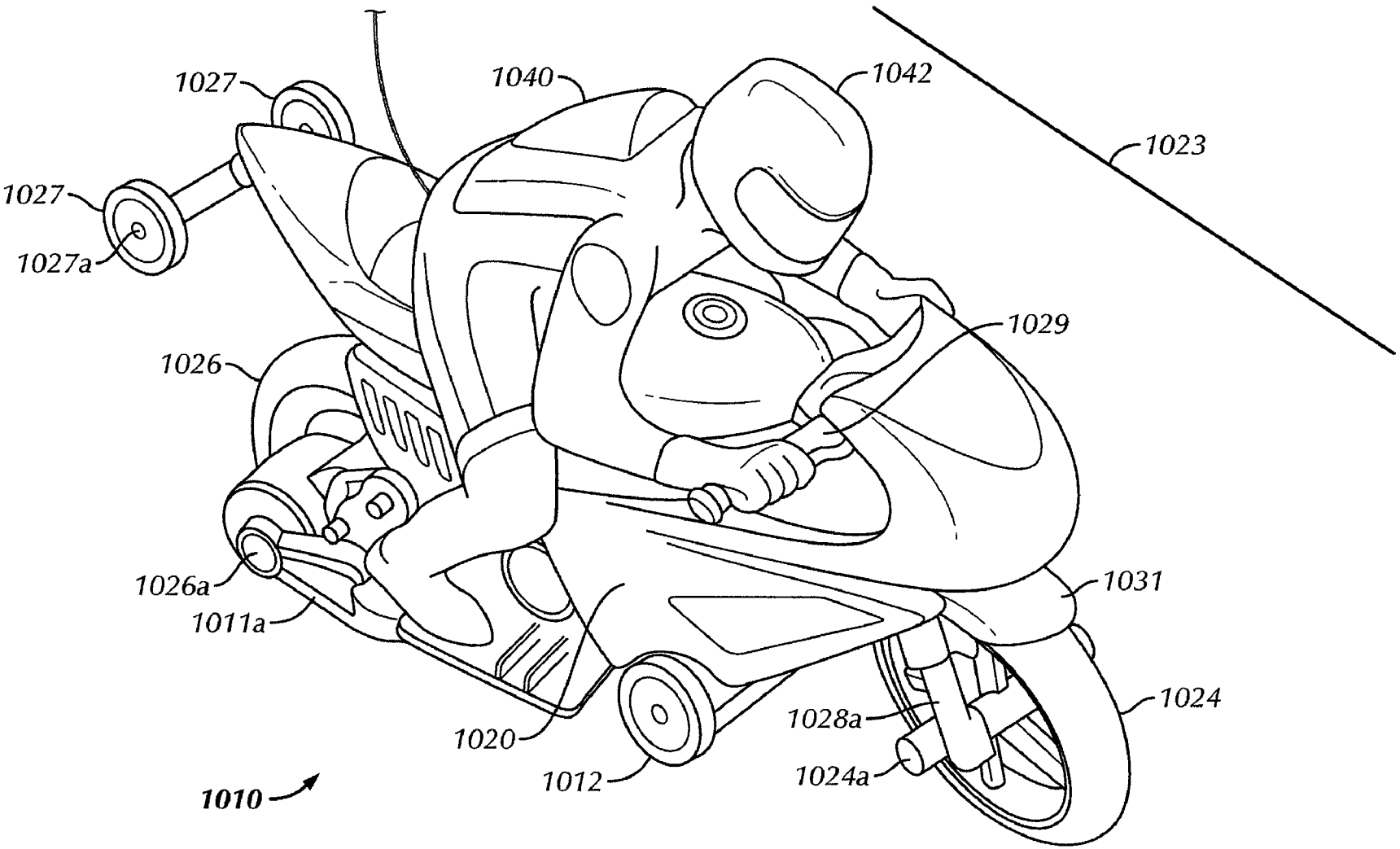
FIG. 7 is a top right side perspective view of a toy vehicle in a generally horizontal operating position in accordance with a second preferred embodiment of the present invention.
Figure 8:
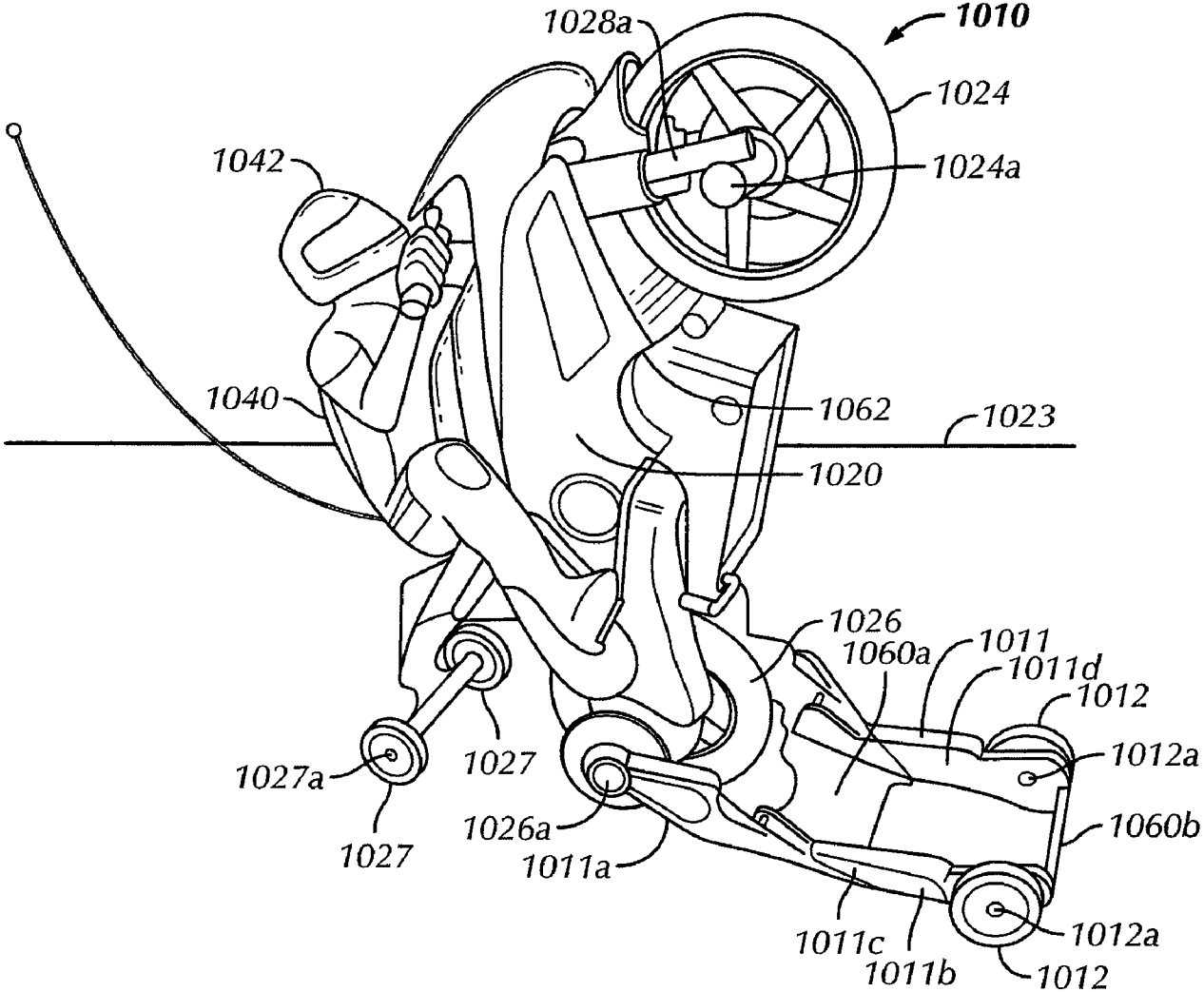
FIG. 8 is a right side perspective view of the toy vehicle shown in FIG. 7, with the toy vehicle "popping a wheelie" or in a generally vertical operating position.

Referring now to FIGS. 7 and 8, a second preferred embodiment of the toy vehicle 1010 is shown, wherein like numerals are utilized to indicate like elements throughout and like elements of the second preferred embodiment are distinguished from like elements of the first preferred embodiment by a factor of one thousand (1000). The structure and operational capabilities of the toy vehicle 1010 of the second preferred embodiment are substantially similar to that of the toy vehicle 10 of the first preferred embodiment described in detail above. For example, as seen in FIGS. 7 and 8, the toy vehicle 1010 of the second preferred embodiment includes a chassis 1020, a rider 1040 attached thereto, at least two spaced apart road wheels 1024, 1026, and at least one but preferably two spaced-apart prop wheels 1027 that extend rearwardly beyond the rear wheel 1026 relative to the front road wheel 1024 when the toy vehicle 1010 is in the generally horizontal operating position (FIG. 7).

Similar to the first preferred embodiment, the toy vehicle 1010 of the second preferred embodiment is capable of being driven and/or maneuvered in the initial or generally horizontal operating position (FIG. 7), in which both the front and rear road wheels 1024, 1026 contact the supporting surface 1023, and a "wheelie," reclined or generally vertical operating position (FIG. 8), in which the front road wheel 1024 is spaced-apart from the supporting surface 1023. However, many of the similarities between the two embodiments, such as the gear reduction system (not shown), the drive system (not shown) and the wheelie system (not shown), will not be described in detail herein for the sake of brevity.

As seen in FIG. 8, one primary difference between the two preferred embodiments is the structure of the wheelie mechanism 1011 of the toy vehicle 1010 of the second preferred embodiment. Specifically, the wheelie mechanism 1011 preferably includes first and second spaced-apart and laterally-extending connectors 1060*a*, 1060*b*, respectively, extending between the first and second wheelie bars 1011*c*, 1011*d*. One end of each connector 1060*a*, 1060*b* is preferably fixedly attached to a portion of the first wheelie bar 1011*c* and a second end of each connector 1060*a*, 1060*b* is preferably fixedly attached to a portion of the second wheelie bar 1011*d*. Thus, the connectors 1060*a*, 1060*b* preferably extend generally perpendicularly to the first and second wheelie bars 1011*c*, 1011*d* and the wheelie mechanism 1011 is preferably a single, integral structure.

Similar to the first preferred embodiment, a first end 1011*a* of the wheelie mechanism 1011 is pivotably mounted preferably to a rear axle 1026*a* of the toy vehicle 1010 also supporting the rear wheel 1026. An opposite second end 1011*b* of the wheelie mechanism 1011 includes at least one but preferably two wheelie wheels 1012 rotatably mounted thereto. As seen in FIG. 8, the two wheelie wheels 1012 are preferably positioned at a spaced-apart distance on opposing exterior sides of the wheelie mechanism 1011 supported by a conventional stub axle or shaft 1012*a* through each of the first and second wheelie bars 1011*c*, 1011*d*. A bias member, such as a coil torsion spring (not shown), preferably connects a portion of the wheelie mechanism 1011 to the chassis 1020 to bias the wheelie bars 1011*c*, 1011*d* toward a bottom of the chassis 1020. In the preferred embodiment, the biasing member preferably surrounds at least a portion of the rear axle 1026*a*. The chassis 1020 preferably includes two spaced-apart arcuate indentations 1062 proximate the bottom thereof that are sized and shaped to receive at least a portion of one of the wheelie wheels 1012. The indentations 1062 allow the wheelie wheels 1012 to be spaced-apart from the supporting surface 1023 when the toy vehicle 1010 is in the generally horizontal operating position (FIG. 7).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. A toy vehicle comprising:

a chassis;

a front road wheel supported for rotation from the chassis and a rear road wheel supported for rotation from the chassis in line with the front road wheel so as to define a central vertical longitudinal plane bisecting each of the front and rear road wheels, each of the front and rear road wheels being supported from the chassis for rotation at least about a central axis of each respective wheel extending transversely to the central vertical longitudinal plane;

a reversible motor supported from the chassis and operatively coupled with one of the front and rear road wheels so as to rotate at least one of the front and rear road wheels to propel the toy vehicle in a forward direction; and a wheelie mechanism operatively connected to the motor and having a first end pivotally attached to the central axis of one of the front and rear wheels wherein operation of the motor in a first rotational direction rotates the one of the front and rear road wheels to propel the toy vehicle to the forward direction and operation of the motor in a second rotational direction rotates the one of the front and rear road wheels to propel the toy vehicle in the forward direction and pivots a second end of the wheelie mechanism away from the chassis.

2. The toy vehicle of claim 1 wherein operation of the motor in the first rotational direction propels the toy vehicle in a generally horizontal operating position in which both the front and rear road wheels contact a supporting surface and operation of the motor in the second rotational direction propels the toy vehicle in a generally vertical operating position in which the front road wheel is spaced-apart from the supporting surface.

3. The toy vehicle of claim 2 further comprising:

at least one prop wheel rotatably supported by an axle at a rear end of the chassis, the at least one prop wheel being generally spaced above the rear road wheel when the toy vehicle is in the generally horizontal operating position.

4. A toy vehicle comprising: a chassis; a front road wheel supported for rotation from the chassis and a rear road wheel supported for rotation from the chassis in line with the front road wheel so as to define a central vertical longitudinal plane bisecting each of the front and rear road wheels, each of the from and rear road wheels being supported from the chassis for rotation at least about a central axis of each respective wheel extending transversely to the central vertical longitudinal plane; a reversible motor supported from the chassis and operatively coupled with one of the front and rear road wheels so as to rotate at least one of the front and rear road wheels to propel the toy vehicle in a forward direction; and a wheelie mechanism operatively connected to the motor and having a first end pivotally attached to the central axis of one of the front and rear wheels wherein the wheelie mechanism includes a first wheelie bar spaced-apart from and extending generally parallel to a second wheelie bar, a first end of the first and second wheelie bars being pivotably mounted to the central axis of one of the rear road wheel, a second end of the first and second wheelie bars including at least one wheelie wheel rotatably mounted thereto.

5. The toy vehicle of claim 1 further comprising:

a bias member connected between the chassis and the wheelie mechanism to bias a second end of the wheelie mechanism toward a bottom of the chassis.

6. The toy vehicle of claim 1 in combination with a manually operated remote control transmitter.

7. A toy vehicle comprising:

a chassis;

a front road wheel supported for rotation from the chassis and a rear road wheel supported for rotation from the chassis, each of the front and rear road wheels being supported from the chassis for rotation about a central axis of each respective wheel;

a motor supported from the chassis;

a wheelie mechanism having a first end pivotally attached to the central axis of one of the front and rear road wheels;

a propulsion system operatively connecting the motor to the rear road wheel, the propulsion system including a series of gears through which the motor effectuates rotation of the rear road wheel to propel the toy vehicle forward; and a wheelie system operatively connecting the motor to the wheelie mechanism, the wheelie system including a series of gears through which the motor effectuates rotation of the wheelie mechanism;

wherein the motor selectively propels the toy vehicle forward in a generally horizontal operating position in which both the front and rear road wheels contact a supporting surface and in a generally vertical operating position in which the front wheel is spaced apart from the supporting surface and the rear road wheel contacts the supporting surface.

8. The toy vehicle of claim 7 in combination with a manually operated remote control transmitter.

9. The toy vehicle of claim 7 wherein the series of gears of the propulsion system includes a propulsion toggle gear having a shaft located on a side face thereof, the shaft being movable with respect to and extending within a first slot positioned within the chassis.

10. The toy vehicle of claim 7 wherein the series of gears of the wheelie system includes a wheelie toggle gear having a shaft located on a side face thereof, the shaft being movable with respect to and extending within a second slot positioned within the chassis.

11. The toy vehicle of claim 10 wherein the series of gears of the propulsion system includes a housing gear surrounding at least a portion of the central axis of the rear road wheel, and wherein the wheelie system includes an extension of the wheelie mechanism extending through and being freely rotatable with respect to the housing gear.

12. The toy vehicle of claim 7 wherein the wheelie mechanism includes an extension extending therefrom and surrounding at least portion of the central axis of one of the front and rear road wheels, the extension being fixedly connected to a base gear operatively engaged with at least one of the series of gears of the wheelie system.

13. A method of driving a toy vehicle having in-line front and rear road wheels and a wheelie mechanism, in a generally horizontal operating position in which the front and rear road wheels contact a supporting surface and in a generally vertical operating position in which one of the front and rear road wheels remains on the supporting surface and a remaining one of the front and rear road wheels is spaced-apart from the supporting surface comprising the steps of:

a) actuating a motor on the toy vehicle to rotate in a first rotational direction to rotate the one of the front and rear road wheels to propel the toy vehicle in a forward direction; and b) actuating the motor to rotate in a second rotational direction to rotate the one of the front and rear road wheels to propel the toy vehicle in a forward direction and to pivot a portion of the wheelie mechanism away from the toy vehicle to raise the remaining one of the front and rear road wheels off of the supporting surface.

14. The method of claim 13 wherein steps a) and b) are performed in response to a command from a control transmitter remote from the toy vehicle.

15. The toy vehicle of claim 11 wherein the housing gear is capable of being rotated independently of the rear axle and the extension of the wheelie mechanism and is fixedly engaged with a central portion of the rear road wheel to rotate the rear road wheel and propel the toy vehicle.

16. The toy vehicle of claim 15 wherein the series of gears of the wheelie system includes a sector gear located between the wheelie toggle gear and a base gear operatively engaged with at least one of the series of gears of the wheelie system gear for intermittent rotational engagement with the base gear.

17. The toy vehicle of claim 16 further comprising a gear reduction system between the motor and the propulsion system and the wheelie system to reduce speed and increase torque at which the motor rotates the rear road wheel and the wheelie mechanism.

18. The toy vehicle of claim 17 wherein the gear reduction system includes a first reduction gear simultaneously meshed with both a first propulsion gear of the propulsion system series of gears and a first wheelie gear of the wheelie system series of gears.

19. The toy vehicle of claim 18 wherein the wheelie system includes a second wheelie gear connected with the first wheelie gear by a shaft and spaced away from the first wheelie gear on an opposite side of the rear wheel.

20. The toy vehicle of claim 7 wherein the rear road wheel is supported for rotation from the chassis on a rear axle and wherein the wheelie mechanism includes a first wheelie bar having a first end pivotally attached to the rear axle and a wheelie wheel rotatably mounted to a second end of the wheelie bar opposite the first end.

* * * * *